US005913097A

United States Patent [19]

Nakano et al.

[11] Patent Number: 5,913,097

[45] Date of Patent: Jun. 15, 1999

[54] DEVELOPING DEVICE, IMAGE FORMING APPARATUS, AND TONER FILLABLE CARTRIDGE THAT INCLUDES AN AGITATOR HAVING A FIRST MEDIUM AND A SECOND MEDIUM

[75] Inventors: Hiroshi Nakano; Kazumasa Makino, both of Nagoya, Japan

[73] Assignee: Brother Kogyo Kabushiki Kaisha, Nagoya, Japan

[21] Appl. No.: 09/028,767

[22] Filed: Feb. 24, 1998

[30] Foreign Application Priority Data

Feb. 28, 1997 [JP] Japan ..... 9-045717

[51] Int. Cl.[6] ..... G03G 15/08

[52] U.S. Cl. ..... 399/256; 366/309; 399/263

[58] Field of Search ..... 399/222, 256, 399/263; 366/309, 310, 312, 313

[56] References Cited

U.S. PATENT DOCUMENTS

| | | | |
|---|---|---|---|
| 20,804 | 7/1858 | Macnish | 366/309 X |
| 604,671 | 5/1898 | Strunz | 366/313 X |
| 5,630,198 | 5/1997 | Makino . | |
| 5,655,195 | 8/1997 | Ichikawa et al. | 399/263 |
| 5,678,147 | 10/1997 | Makino . | |
| 5,697,014 | 12/1997 | Makino . | |
| 5,710,961 | 1/1998 | Jeong | 399/256 |

*Primary Examiner*—S. Lee

*Attorney, Agent, or Firm*—Oliff & Berridge, PLC

[57] ABSTRACT

A developing device for use with an image forming apparatus can properly detect a residual toner level by adjusting the toner diffusion in a toner cartridge. The developing device stirs toner in the toner cartridge by rotating an agitator in the toner cartridge, and supplies the stirred toner from a toner introduction port. The image forming apparatus then forms images by electrophotographic processes. The agitator has at least two elastic film members and is formed so that the first film member is rotated first, then the second film member is rotated by following the first film member.

21 Claims, 16 Drawing Sheets

DEVELOPING DEVICE, IMAGE FORMING APPARATUS, AND TONER FILLABLE CARTRIDGE THAT INCLUDES AN AGITATOR HAVING A FIRST MEDIUM AND A SECOND MEDIUM

BACKGROUND OF THE INVENTION

1. Field of the Invention

The invention relates to a developing device for use with an image forming apparatus that forms images by electrophotographic processes. Toner is supplied from a toner introduction port after being stirred in a toner cartridge by the rotation of an agitator that is attached to a rotary shaft in the toner cartridge which forms a toner reservoir. The invention also relates to a toner cartridge for use with the developing device. More particularly, the invention relates to a developing device for use with an image forming apparatus, which controls the toner in the toner cartridge properly with respect to the diffusion of toner.

2. Description of the Related Art

Various types of developing devices have been proposed for use with electrophotographic image forming apparatuses such as laser printers. Most of these developing devices are formed so that they can be mounted on laser printers as a module device. In addition, they are provided with a replaceable toner cartridge which is used as a toner reservoir.

An example of such a developing device will be explained with reference to FIG. 17. FIG. 17 shows an essential portion of a typical related art developing device.

As shown in FIG. 17, the developing device is provided with a toner cartridge 100 that contains toner and has a toner introduction port 101. An agitator 103 is provided in the toner cartridge 100 that stirs toner. A toner introduction port F0 is formed at a frame F of a process cartridge holding the toner cartridge 100, corresponding to the toner introduction port 101 of the toner cartridge 100. A toner supply roller 104 is rotatably disposed in the lower portion of a developing chamber 102 that is defined by an upper frame F1 and a lower frame F2. A developing roller 105 is adjacent to the toner supply roller 104. The supply roller 104 supplies the toner to the developing roller 105 via port 101 and port F0.

In addition, a blade 107 is fixed to the inner wall of the upper frame F1 via a fixing member 106 at a position above the developing roller 105. The blade 107 limits the thickness of the toner layer formed on the surface of the developing roller 105. Furthermore, the developing roller 105 is disposed so as to contact a photosensitive drum 108. An electrostatic latent image is formed on the surface of the photosensitive drum 108 by a light exposure device (not illustrated) that scans a laser beam according to image data. The developing roller 105 develops images with toner supplied to the latent image formed on the surface of the photosensitive drum 108. The image developed on the photosensitive drum 108 with the toner is then transferred onto a sheet supplied from a sheet feeder (not illustrated).

In the toner cartridge 100 for use with a developing device as mentioned above, the toner in the cartridge 100 is slowly consumed, so that a residual toner level is detected. When the level is low, the toner cartridge 100 must be replaced. If the toner cartridge which is used as a toner reservoir is formed integrally with the process cartridge and cannot be removed from the process cartridge, the process cartridge must also be replaced with the toner cartridge. In order to detect the residual toner level, an optical sensor is generally disposed to detect toner existing at a detecting point in the toner cartridge 100.

When an ample supply of toner remains in the toner cartridge 100, the toner blocks the sensor beam at the detecting point. The toner, however, scatters when the agitator is rotated. The sensor beam thus passes the detecting point without detecting any toner, even though an ample amount of toner still remains. This results in a false detection (that the toner level is low) in some cases.

SUMMARY OF THE INVENTION

It is therefore an object of the invention to solve the above related art problems and provide a developing device for use with an image forming apparatus, which can adjust the toner in the toner cartridge with respect to diffusion of the toner to detect the residual toner level properly. It is also an object of the invention to provide a toner cartridge for use with such a developing device.

In order to achieve the above object, a developing device is provided for use with an image forming apparatus which forms images by electrophotographic processes using toner supplied from the toner introduction port after being stirred in a toner reservoir by the rotation of an agitator. The agitator is attached to the rotary shaft in the toner reservoir. The agitator comprises at least two elastic thin media and is formed so that the first medium is rotated initially. Then, the second and subsequent media are rotated by following the first one.

In the case of such an agitator comprising at least two elastic thin media, when the first medium is rotated, toner is pushed out and stirred. The toner, however, begins flowing behind the medium and then in the reverse direction. To prevent this, the second and subsequent media are rotated by following the first one. Since this agitator can adjust the toner diffusion within the reservoir, the agitator can suppress scattering of the toner at the detecting point of the sensor and accordingly prevent false detections of the toner sensor.

The image forming apparatus that forms images by electrophotographic processes mentioned above includes, for example, a laser printer that prints out images by developing electrostatic latent images formed on the surface of a photosensitive body such as a photosensitive drum supplied with toner, as well as by transferring the images developed on the photosensitive body with the toner onto a sheet.

In accordance with the developing device for use with the image forming apparatus, the toner stirring member of the first thin medium is shorter than the toner stirring member of the second thin medium in the radial direction. Accordingly, when the toner stirred by the first medium begins flowing behind the medium and then in the reverse direction, the second and subsequent media that follow the first one prevents the toner from reverse flowing and adjusts the toner in the reservoir with respect to toner scattering.

In accordance with the developing device for use with the image forming apparatus, the toner stirring members of the first, second, and subsequent thin media are all formed to be longer than the radius of the toner reservoir in the radial direction. Accordingly, the tip of each elastic thin medium contacts the inner surface of the toner stirring member to be bent to push toner out and stir it in the rotating direction. Thus, the toner can be sufficiently stirred and supplied to the developing device properly.

Furthermore, in accordance with the developing device for use with the image forming apparatus, an elastic thin wiping medium is attached to the rotary shaft to wipe the toner stuck on the detecting point in the toner reservoir. The thin wiping medium and the agitator are positioned on both sides of the rotary shaft.

With this arrangement, the agitator comprising at least two elastic thin media operates so that when the toner, which is pushed out and stirred by the rotation of the first medium, begins flowing behind the medium and then in the reverse direction and scatters, the second and subsequent media are rotated by following the first one to receive the toner and prevent the toner from such troubles. Since the agitator can adjust the toner diffusion in the reservoir, it can also suppress scattering of the toner, for example, at the toner detecting point of the sensor, as well as prevent false detections of the toner sensor.

Furthermore, the developing device for use with the image forming apparatus can adjust the amount of toner supplied from the toner introduction port by changing the shape of each toner stirring member of the thin media.

Furthermore, in accordance with the image forming apparatus which forms images by electrophotographic processes using toner stirred by the rotation of the agitator attached to the rotary shaft in the toner reservoir and supplied from the toner introduction port, the agitator, comprising at least two elastic thin media, is formed so that the first medium is rotated first, then the second and subsequent media are rotated by following the first one. Furthermore, a residual toner level sensor is disposed outside of the toner reservoir that detects toner existing at the detecting point in the toner reservoir. Thus, when the thin media are rotated, toner movement can be adjusted at least at the toner detecting point.

Consequently, in accordance with the image forming apparatus, when the first medium of the agitator comprising at least two elastic thin media is rotated, toner is pushed out, stirred, and begins flowing behind the medium, and then in the reverse direction. To prevent this, the second and subsequent media are rotated by following the first one. Since the agitator can adjust the toner diffusion in the reservoir, it can minimize the amount of toner stuck on the residual toner detecting point of the toner sensor and prevent false detections of the sensor.

Furthermore, according to the toner cartridge for use with the developing device, the toner cartridge is used as the developing device for an image forming apparatus that forms images by electrophotographic processes using toner supplied from a toner introduction port after being stirred by the rotation of an agitator attached to a rotary shaft in the toner cartridge. The agitator, comprising at least two elastic thin media, is formed so that the first medium is rotated first, then the second and subsequent media are rotated by following the first one.

Consequently, toner is pushed out and stirred when the first medium of the agitator is rotated in the toner cartridge. At this time, however, the toner begins to flow behind the medium and then in the reverse direction and scatters. To prevent this, the second and subsequent media are rotated by following the first one. Since the agitator can adjust the toner diffusion in the toner cartridge, the agitator can suppress the scattering of toner, for example, at the toner detecting point of the toner sensor and prevent false detections of the sensor.

BRIEF DESCRIPTION OF THE DRAWINGS

A preferred embodiment of the invention will be described in detail with reference to the following drawings wherein.

DETAILED DESCRIPTION OF THE PREFERRED EMBODIMENTS

Hereunder, the developing device for use with an image forming apparatus, the image forming apparatus, and the toner cartridge for use with the developing device of the invention will be explained in detail with reference to the attached drawings according to the described embodiments for a laser printer.

Figure 1:
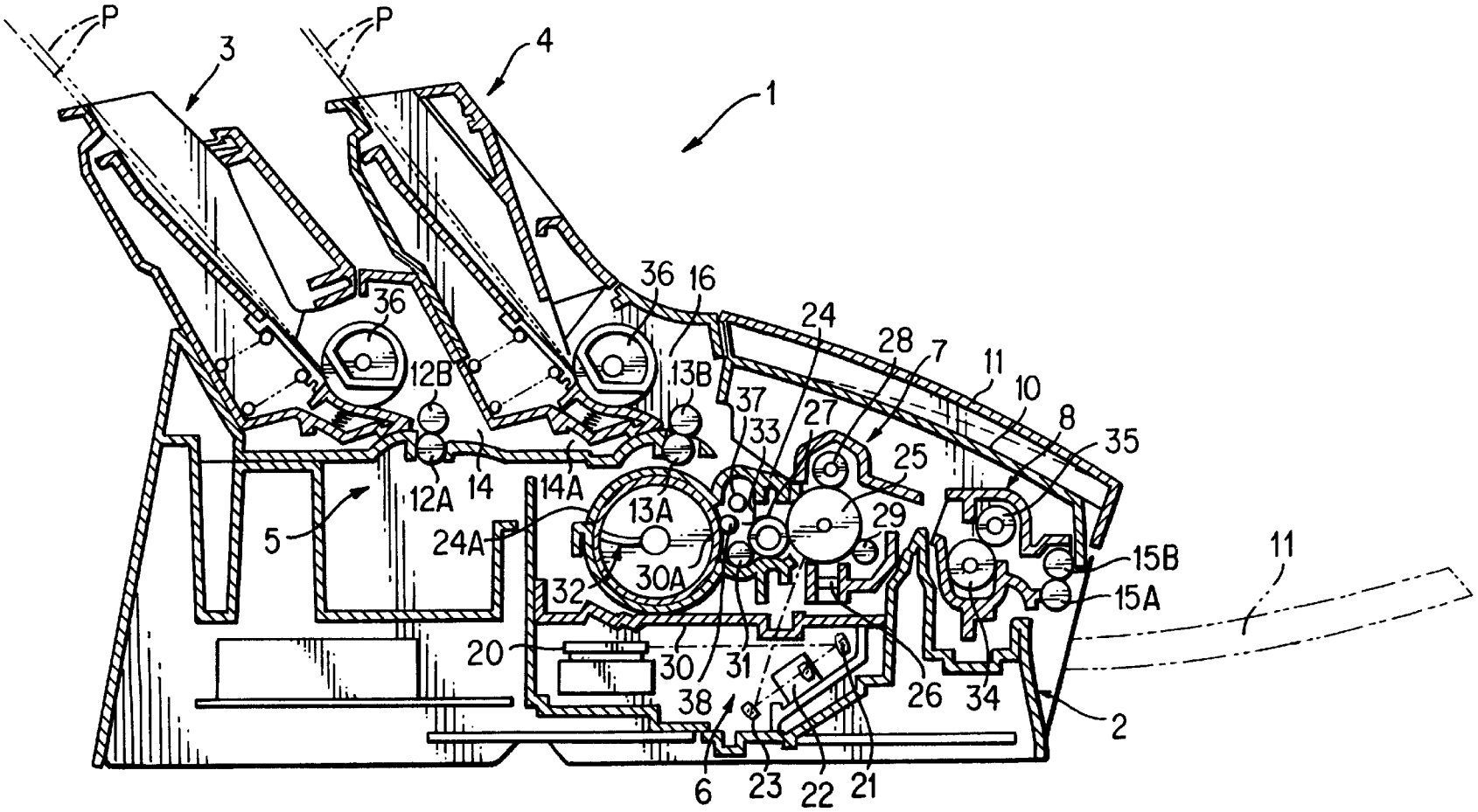
FIG. 1 is a side cross sectional view of a laser printer in accordance with an embodiment of the invention.
Figure 2:
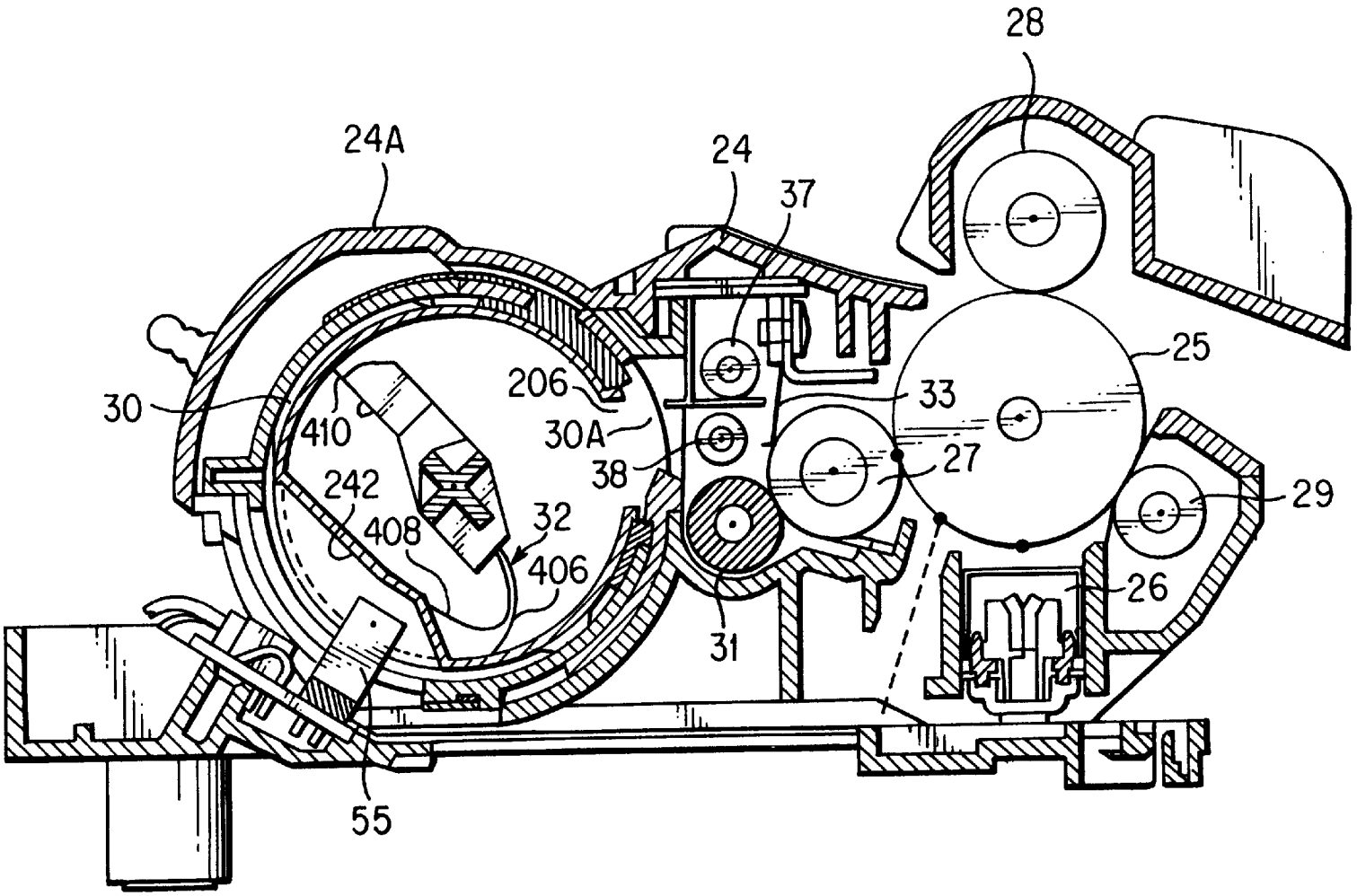
FIG. 2 is a side cross sectional view of a process cartridge in accordance with an embodiment of the invention.
Figure 3:
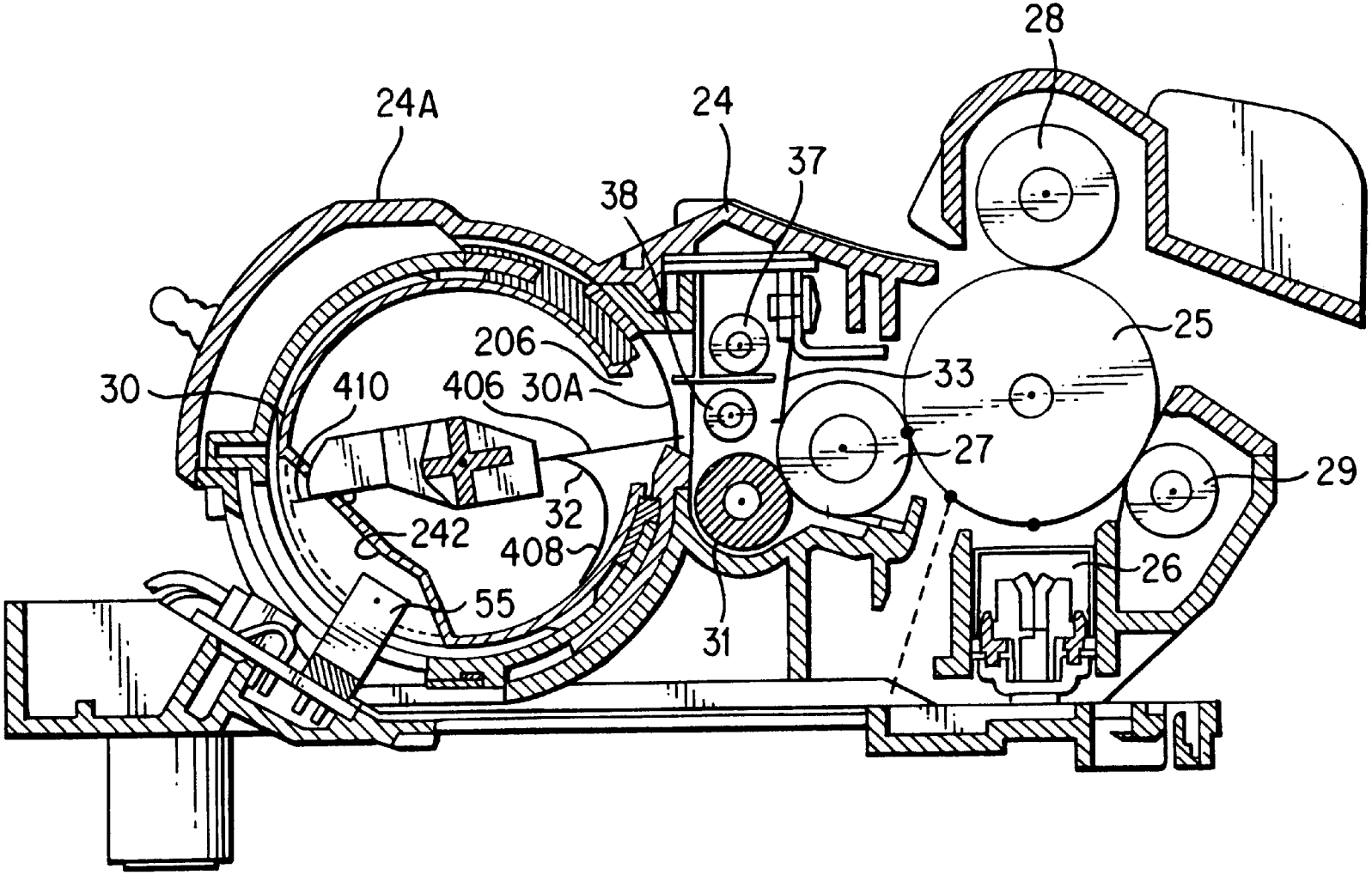
FIG. 3 is a side cross sectional view of the process cartridge in accordance with the embodiment shown in FIG. 2.

First, a schematic of the laser printer in accordance with an embodiment of the invention will be explained with reference to FIG. 1. FIG. 1 is a side view of the laser printer. FIGS. 2 and 3 are side cross sectional views of the process cartridge of the laser printer. FIG. 3 particularly shows how toner is supplied in the cartridge.

In FIG. 1, the laser printer 1 comprises a body case 2, a first sheet feed tray 3 provided in the top rear of the body case 2, a second sheet feed tray 4, a sheet carrier mechanism 5 provided in the body case 2, a scanner device 6, a process cartridge 7, a fixing device 8, as well as a driving device (not illustrated, housed at the left end of the body case 2) that drives the first and second sheet feed trays 3 and 4 and sheet carrier mechanism 5, and similar mechanisms. On the front top of the body case 2 are provided a top cover 10 that allows the top of the printing mechanism to be opened and a sheet unloading tray 11. The sheet unloading tray 11 can be closed and opened freely. When opened, the sheet unloading tray receives printed sheets P.

The scanner device 6, the process cartridge 7, and the fixing device 8 form a printing mechanism. The process cartridge 7 includes a casing 24. A photosensitive drum 25, a charger 26, a developing roller 27, a transfer roller 28, and a cleaning roller 29 are provided in the casing 24. The cartridge 7 can be mounted/dismounted at/from a specified position in the body case 2.

The first sheet feeding tray 3 is fixed on top of the body case 2 at the rear end of the case 2. The second sheet feeding tray 4 is provided on the top front of the first sheet feeding tray 3 in the body case 2 so as to be mounted/removed on/from position. The sheet feeding mechanism 5 feeds the sheets P fed selectively from the first or second sheet feeding tray to the process cartridge 7. The mechanism 5 includes a pair of feed rollers 12A and 12B provided at the lower end of the first sheet feeding tray 3, and a pair of resist rollers 13A and 13B provided at the lower end of the second sheet feeding tray 4. Feed roller 12A is a driving roller. Feed roller 12B is a driven roller. Resist roller 13A is a driving roller and resist roller 13B is a driven roller.

The sheet feeding path 14 formed between the first sheet feeding tray 3 and the resist rollers 13A and 13B includes a lower feeding path 14A. The lower feeding path 14A extends along the lower surface of the second sheet feeding tray 4. When the second sheet feeding tray 4 is removed from the body case 2, the lower sheet feeding path 14A is open to the exterior of the device.

The sheet P fed from the first sheet tray 3 via a pick-up roller 36 is then fed by a pair of feeding rollers 12A and 12B to the resist rollers 13A and 13B along the lower path 14A to receive a resist treatment. The sheet P is then fed to the process cartridge 7. The sheet P fed from the second sheet tray 4 via a pick-up roller 36 reaches the resist rollers 13A and 13B to be resisted. The sheet P is then fed to the process cartridge 7.

The scanner device 6 is disposed under the process cartridge 7. The device 6 includes a laser emitter (not illustrated), a polygon mirror 20, a reflection mirrors 21 and 23, and a lens 22. The laser beam emitted from the laser emitter is focused on the outer peripheral surface of the charged rotating photosensitive drum 25 at a high scanning speed via the polygon mirror 20, the reflection mirror 21, the lens 22, and the reflection mirror 23 as shown with a chain line. An electrostatic latent image exposed to the laser beam is formed on the surface of the photosensitive drum 25.

As shown in FIG. 2, the photosensitive drum 25, the scorotoron type charger 26, the developing roller 27, the transfer roller 28, the cleaning roller 29, the toner cartridge 30, and the toner supply roller 31 are provided in the casing 24 of the process cartridge 7. When the process cartridge 7 is removed from the body case 2, the toner cartridge 30 can be removed from the process cartridge 7. The toner in the toner cartridge 30 is stirred by the stirring member (agitator) 32 and discharged from the opening 30A of the process cartridge 7 and from the opening 206 of the toner cartridge 30. The toner is then supplied to the developing roller 27 via the toner supply roller 31. The developing roller 27 is retained as a toner layer having a fixed thickness. The toner layer is then supplied to the photosensitive drum 25.

Two auger members 37 and 38 are rotatably disposed at the opening 30A of the process cartridge. Each of the auger members 37 and 38 uniformly scatter the toner that is discharged from the openings 30A and 206 in the casing 24.

In order to detect the residual toner level in the toner cartridge 30, a toner sensor 55 is provided in the lower portion outside of the toner cartridge 30 (see FIG. 2). The toner sensor detects the residual level of toner existing at a toner detecting point 240 (see FIG. 7) in the toner cartridge 30 as described below.

The developing roller 27 supplies toner to the photosensitive drum 25. Toner sticks to the surface of the photosensitive drum 25 to develop the electrostatic latent image formed on the surface of the photosensitive drum 25. The latent image is then transferred to the sheet P while the sheet P is fed between the photosensitive drum 25 and the transfer roller 28. The sheet P is then fed into the fixing device 8 and the latent image is fixed to the sheet P. The toner that remains on the surface of the photosensitive drum 25 is collected temporarily by the cleaning roller 29, and then collected by the developing roller 27 via the photosensitive drum 25 at a specified timing.

The fixing device 8 heats and fixes toner to the sheet P. The device 8 includes a heating roller 34, a pressure roller 35 pressed by the heating roller 34, and a pair of unloading rollers 15A and 15B provided downstream of the rollers 34 and 35 and which unload the sheet P to the outside of the body case 2. Thus, the laser printer prints out images by electrophotographic processes by supplying toner to the electrostatic latent images formed on the surface of the photosensitive drum 25 and developing the latent images with the toner, as well as transferring the images developed with the toner on the surface of the photosensitive drum 25 onto the sheet P. Thus, the images are formed.

The speed that the sheet P is fed via the photosensitive drum 25 and the transfer roller 28 of the process cartridge 7 is set to be equal to or greater than the speed that the sheet P is fed via the heating roller 34, the pressure roller 35, and the unloading rollers 15A and 15B. This is because when the speed that the sheet P is fed via the heating roller 34, the pressure roller 35, the unloading rollers 15A and 15B is greater than the speed that the sheet P is fed via the photosensitive drum 25 and the transfer roller 28, the sheet P is pulled at the nipping point between the photosensitive drum 25 and the transfer drum 28 by which the toner image is transferred onto the sheet P. This pulling may cause the toner image to be disturbed and offset on the sheet P.

Figure 4:
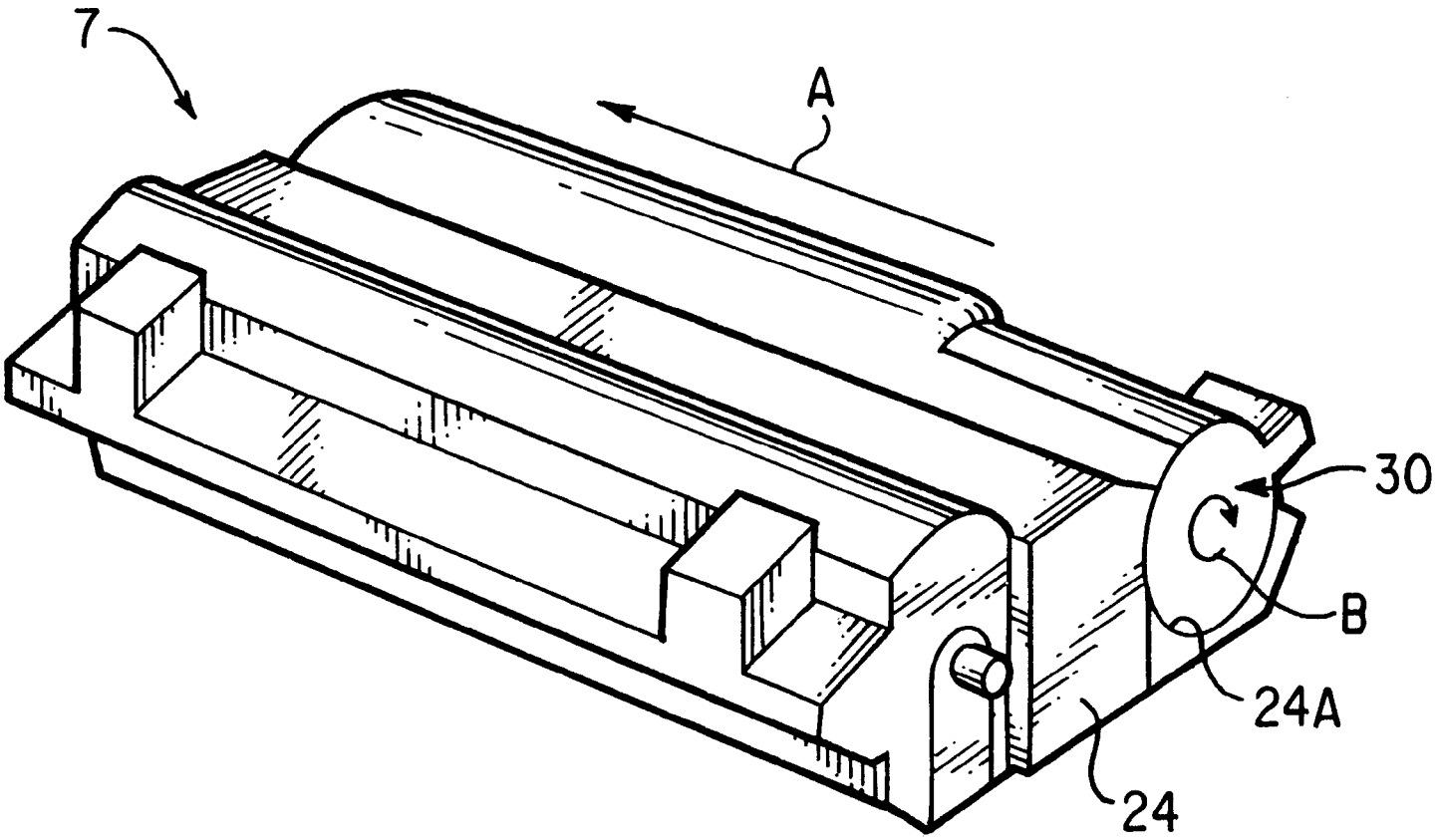
FIG. 4 is a perspective view of the process cartridge in accordance with the embodiment shown in FIG. 2.
Figure 5:
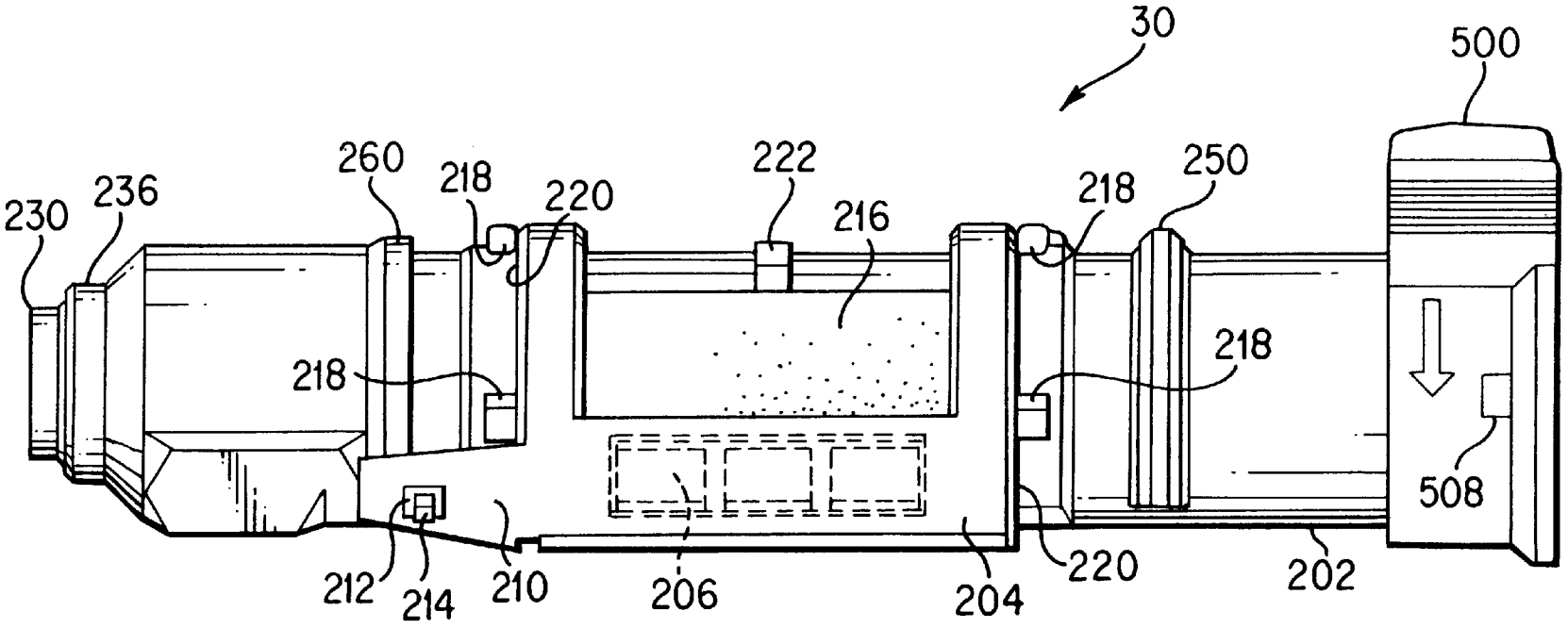
FIG. 5 is a front view of the toner cartridge in accordance with the embodiment shown in FIG. 2.
Figure 6:
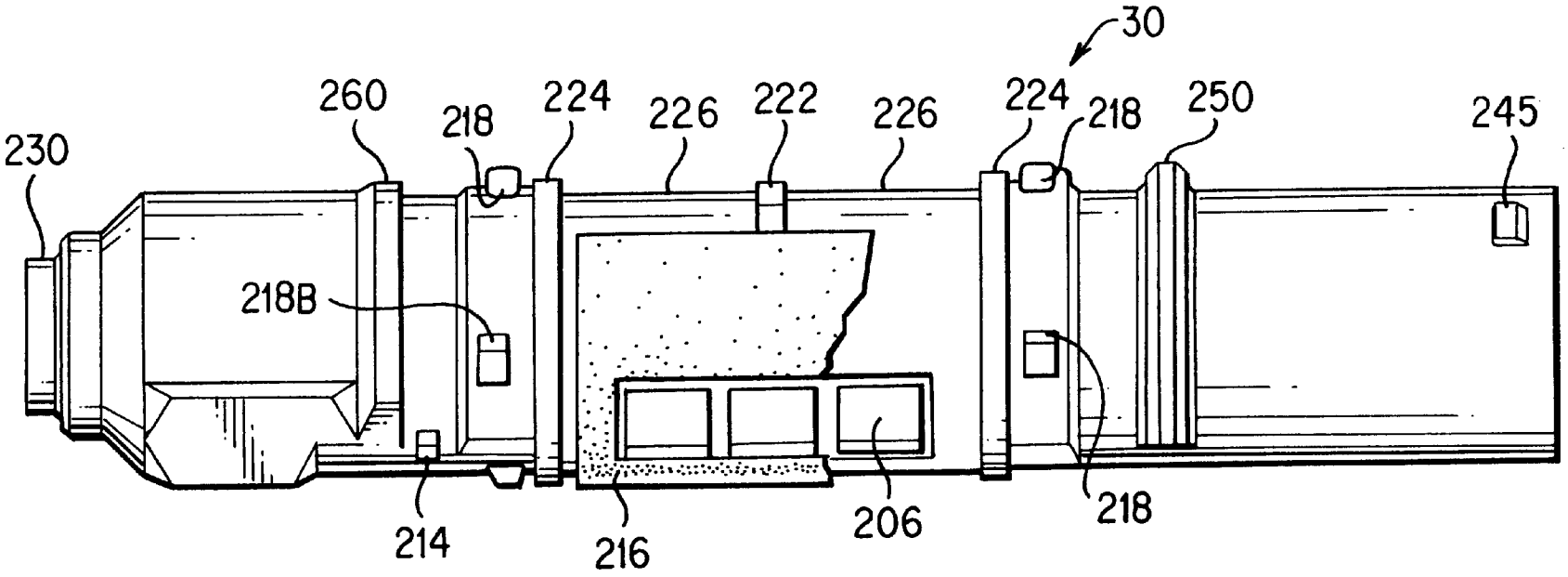
FIG. 6 is a rear view of the toner cartridge in accordance with the embodiment shown in FIG. 2.
Figure 7:
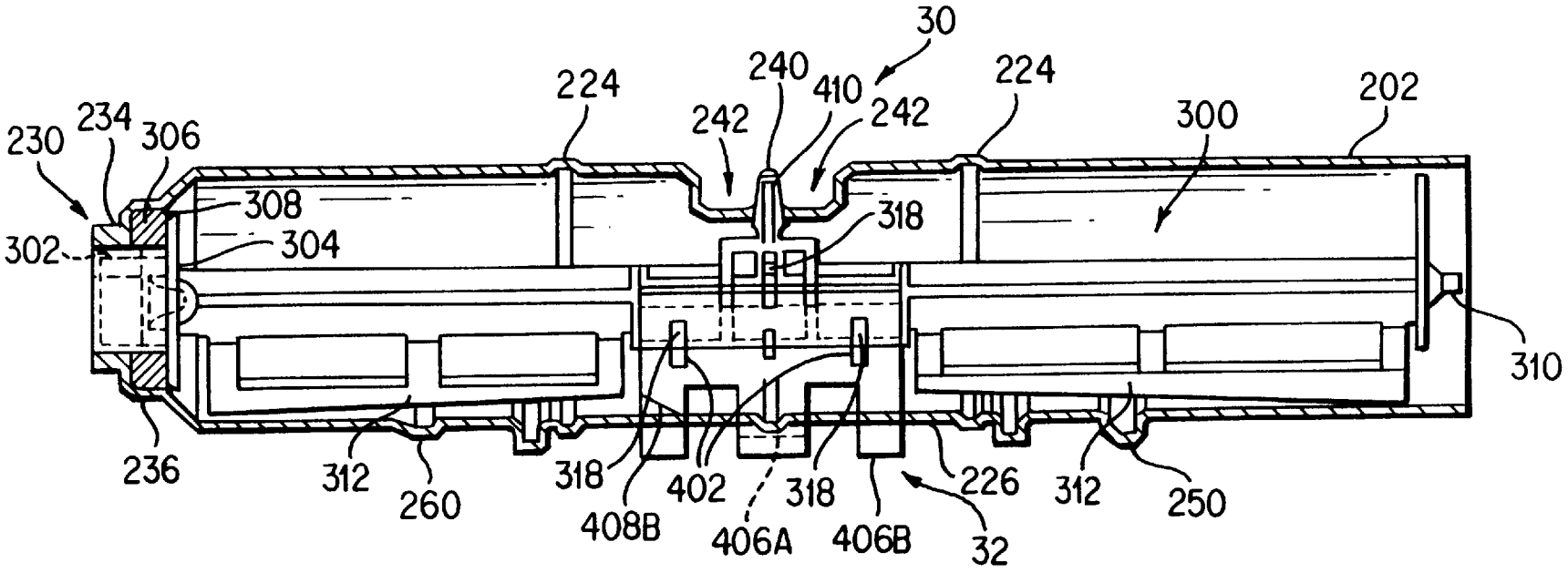
FIG. 7 is a cross sectional view of the toner cartridge in accordance with the embodiment shown in FIG. 2.

Subsequently, the structure of the process cartridge 7 and the toner cartridge 30 will be explained in detail with reference to FIGS. 4–7. FIG. 4 is a perspective view of the process cartridge 7 in which the toner cartridge 30 is mounted. FIGS. 5–7 show the process cartridge 7 from which the toner cartridge 30 is removed. More particularly, in FIG. 6, the toner introduction port shielding member 204 and the cap 500 are omitted to make it easier to understand the structure. FIG. 7 is a cross sectional view of the internal structure of the toner cartridge 30.

In this embodiment, the toner cartridge 30 that contains toner is formed so as to be freely mountable to, and dismountable from, the opening 24A at one side of the process cartridge 7. Specifically, when the toner cartridge 30 is inserted in the process cartridge 7 via the longitudinal direction (in the direction of the arrow A in FIG. 4), the toner cartridge 30 is rotated in the circumferential direction (in the direction of arrow B in FIG. 4) to mount the toner cartridge 30 in the process cartridge 7.

The toner cartridge 30, as shown in FIGS. 5 and 6, includes a substantially cylindrical blow-molded resin body 202, a cap 500 blocking one of the openings of the resin body 202, a toner introduction port shielding member 204 for opening/closing the toner introduction port 206 provided in the center of the resin body 202, and a sponge toner sealing member 216 fixed by the surrounding the toner introduction port 206. A stirring member (agitator) 32 with respect to a shaft 300 extends in the longitudinal direction of the resin body 202 and operates as a rotary shaft in the resin body 202. When the toner introduction port shielding member 204 is moved along the outer periphery of the resin body 202, the toner introduction port 206 can be opened and closed as explained below. Consequently, as shown in FIGS. 2 and 3, when the stirring member 32 in the toner cartridge 30 is rotated, the toner is stirred and supplied from the opening 206 of the toner cartridge 30. The toner sealing member 216 seals the toner so that it does not leak from the toner introduction port 206.

First, the blow-molded resin body 202 will be explained.

The blow-molded resin body 202 is made of resin which is very flexible and does not chemically react with toner. It can also prevent the inner surface of the cartridge 30 from being clogged with toner. The resin body 202 can be made of vinyl chloride, polypropylene, or polyethylene terephthalate (PET) resin, which is particularly favorable because it is inexpensive and for its recycling properties.

A plurality of projections and recesses are integrally formed in the blow-molded resin body 202. A projection 214 is formed integrally in the resin body 202 and extends into a hole 212 provided on an extension 210 of the introduction port shielding member 204. The projection 214 operates to position the toner introduction port shielding member 204 in its closing position. When the extended part 210 is fit in a fixed releasing member (not illustrated) of the process cartridge 7, the projection 214 is released from the hole 212. The toner introduction port shielding member 204, which can rotate freely with respect to the resin body 202, exposes the toner introduction port 206. In addition, a projection 218, which is provided at both sides of the introduction port shielding member 204, moves and guides the toner introduction port shielding member 204 along the outer periphery of the resin body 202.

As shown in FIG. 6, a plurality of guide ribs are formed on the outer periphery of the resin body 202. The center rib 222, as an example of the guide ribs, can guide the center portion of the toner introduction port shielding member 204 in the direction of the outer periphery of the resin body 202.

A pair of side guide ribs 224 are disposed immediately below the toner introduction port shielding member 204, adjacent to the projections 218. In the area around the pair of guide ribs 224, the center rib 222 and the side ribs 224 are combined to form a small gap between the inner face of the shielding member 204 and the outer periphery surface of the resin body 202.

A main rib 250 and a supplemental rib 260 are provided on both sides of the projection 218 on the outer periphery of the resin body 202. The main and supplemental ribs 250 and 260 are formed to protrude from the outer periphery surface 226 of the resin body 202. The main rib 250 protrudes from the outer peripheral surface 226 further than the supplemental rib 260 (see FIG. 7). Because of the respective heights of the main and supplemental ribs 250 and 260, the toner cartridge 30 can be inserted in the mounting opening 24A of the process cartridge 7 in the direction of the arrow shown in FIG. 4.

The toner detecting point 240, located in the center of the resin body 202, is tapered. In other words, a large recess 242 is formed on both sides of the toner detecting point 240 of the resin body 202. Thus, the toner detecting point 240 is shaped so that its cross sectional width decreases in the outward direction. The light emitter of the toner sensor 55 is fit in one of the recesses 242, and the light receiver of the toner sensor 55 is fit in the other recess 242. Therefore, the light receiver (not illustrated) of the toner sensor 55 can receive the beam emitted from the light emitter (not illustrated) of the toner sensor 55 after the beam passes the toner detecting point 240. The toner can thus be detected optically at the toner detecting point 240.

In order to detect toner in this manner, the resin body 202 is preferably made of a half-transparent resin material such as polypropylene. This is because when the resin body 202 is half-transparent, the sensor beam can travel far enough to detect the toner level, while unnecessary peripheral lights can be reduced and absorbed.

The toner sensor 55 malfunctions when toner sticks to the toner detecting point 240. To prevent such a malfunction, therefore, the toner detecting point 240 must be cleaned immediately prior to toner detection. In this embodiment, therefore, a wiping film 410 is provided at the stirring member 32 to periodically wipe the toner off of the detecting point 240. The wiping film 410 is made of a film-like elastic material in a shape of an arrow feather. Thus, the inner surface of the toner detecting point 240 can be wiped properly.

The stirring member 32, as shown in FIGS. 8A-8D, has a shaft 300 that extends in the longitudinal direction. One end of the shaft 300 forms a flanged bearing pin 310. The other side forms a power transmitting member for rotating the stirring member. A center rocking feather 400 is disposed on the opposite side of the shaft 300 from the wiping film 410. A pair of horizontal rocking feathers 312 are formed on both sides of the center rocking feather 400.

Figures 8A, 8B, 8C, 8D:
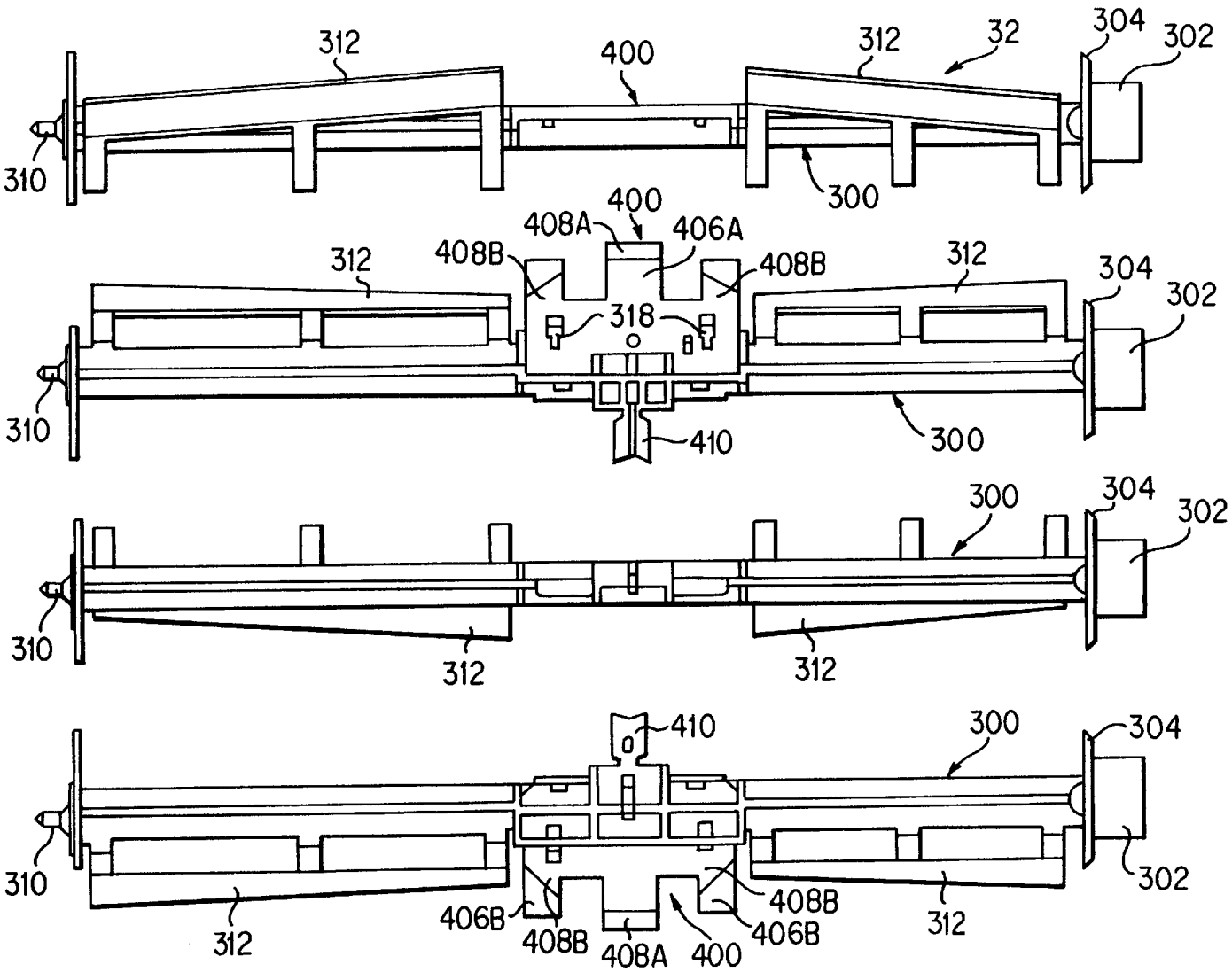
FIGS. 8A–8D show a stirring member in accordance with the embodiment shown in FIG. 2.

FIG. 8A is a top view of the stirring member 32. FIG. 8B is a front view of the stirring member 32. FIG. 8C is a bottom view and FIG. 8D is a rear view of the stirring member 32.

The edge of each of the pair of horizontal rocking feathers 312 preferably extends so as to come in close contact with the inner surface of the resin body 202 on its full length and rake up toner from the edge. For this purpose, each horizontal rocking feather 312 is preferably made of a material that can be elastically transformed.

The center rocking feather 400 is made, for example, of thin film members 406 and 408 that are fixed to the shaft 300 by a plurality of clips 318 which are formed integrally with the shaft 300. The clips 318 fit into a plurality of recesses 402 that are notched into the center rocking feather 400.

The center rocking feather 400 for stirring the toner in the toner cartridge 30 and supplying the toner into the opening 206 comprises at least two elastic film members 406 and 408. The rocking feather 400 is formed so that after the first film member 406 is rotated, the second film member 408 is rotated by following the first member 406. (See FIGS. 2 and 3.)

Consequently, in accordance with the agitator 32 that comprises the two elastic film members 406 and 408, when the first film member 406 is rotated, toner is pushed out and stirred. At this time, however, the toner begins flowing behind the film member 406 and then in the opposite direction. To prevent this, therefore, the second film member 408 rotates by following the first member 406 to receive the toner and prevents the reverse flowing of toner. When toner is consumed so that the toner cartridge 30 is approximately ⅓ full, the first film member 406 falls from the recess 242 shown in FIG. 2. Then, the toner scatters at the toner detecting point 240, and accordingly the light beam from the toner sensor 55 is apt to pass the detecting point without detecting toner. However, the second film member 408 prevents the toner from scattering.

Figure 16A:
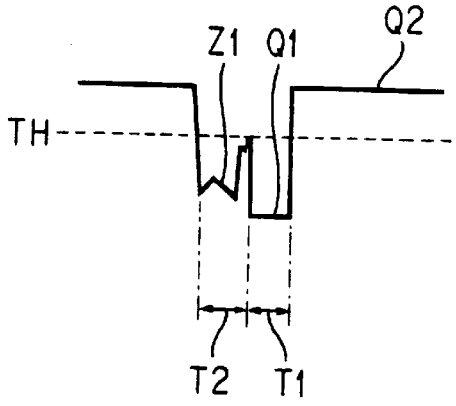
FIGS. 16A–16B show a wave form that occurs when a residual toner level in the toner cartridge is detected.
Figure 16B:
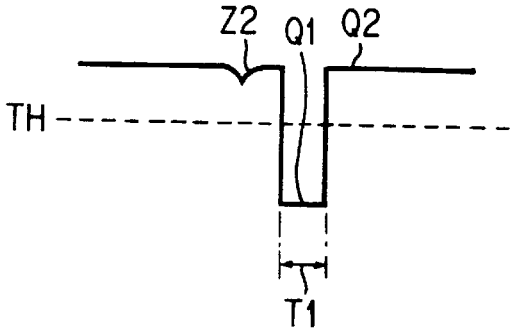
Figure 17:
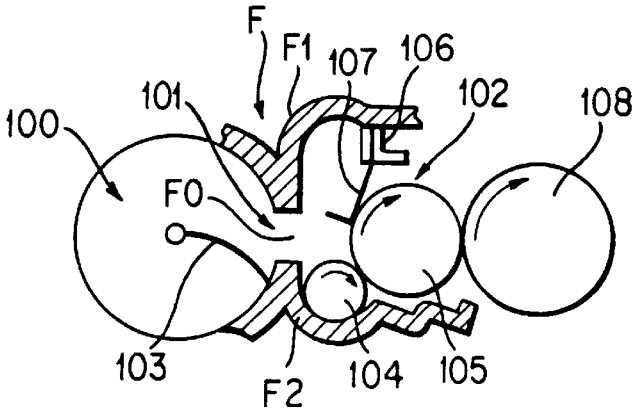
FIG. 17 RELATED ART
FIG. 17 shows an essential portion of a related art developing device.

The operation of how the agitator 32 detects the residual toner level in the toner cartridge 30 will be explained with reference to the wave form shown in FIGS. 16A–16B. In order to make it easier to understand the operation of the agitator 32, FIG. 16A shows a wave form of residual toner detection when the agitator comprises only one film member. FIG. 16B shows a wave form of residual toner detection when the agitator 32 comprises two thin media 406.

The toner that blocks the sensor beam at the detecting point 240 in the toner cartridge 30 scatters when the wiping film 410 of the agitator 32 is rotated. Thus, the beam of the toner sensor 55 passes the detecting point 240 without detecting toner, which causes the voltage of the detection signal to become lower than the threshold voltage TH (signal Q1). If enough toner is still left in the toner cartridge 30, the toner returns to the toner detecting point 240 immediately, so the detection signal voltage becomes higher than the threshold voltage TH (signal Q2).

However, if the toner in the toner cartridge 30 is consumed so that it is only ⅓ full, the toner does not return to the toner detecting point 240 immediately, and the time T1 required for the detection signal voltage to become higher than the threshold voltage TH becomes longer. Consequently, the residual toner level in the toner cartridge 30 can be detected by detecting the length of this time T1, and comparing it with a preset time corresponding to the residual toner level.

When the agitator has only one film member, however, the toner that should exist at the detecting point 240 to block the sensor beam is scattered due to the rotation of the film member. Then, as shown in FIG. 16A, the beam from the toner sensor 55 passes the detecting point without detecting any toner, and the detection signal voltage becomes lower than the threshold voltage TH (signal Z1) in some cases. If the time T2 in which the detection signal voltage becomes lower than the threshold TH matches the time T1 in which the wiping film 410 wipes off toner, the time T2 becomes longer. In such a case, the toner sensor 55 may falsely detect that toner is low, although in actuality enough toner still exists.

However, when the agitator has two film members 406 and 408 as shown in this embodiment, the first film member 406 falls from the recess 242 as shown in FIG. 2. Then, the second film member 408 prevents the toner at the toner detecting point 240 from scattering. Consequently, as shown in FIG. 16B, toner blocks the beam from the toner sensor 55. Accordingly, the detection signal voltage never becomes lower than the threshold voltage TH (signal Z2).

When the agitator 32 has the second film member 408, the residual toner level in the toner cartridge 30 can be measured accurately by comparing the time T2 with the time T1, which is a detecting time of the beam from the toner sensor 55 when the toner is wiped off by the wiping film 410 from the toner detecting point 240. This enables the toner sensor 55 to be protected from false detection.

Figure 9A:
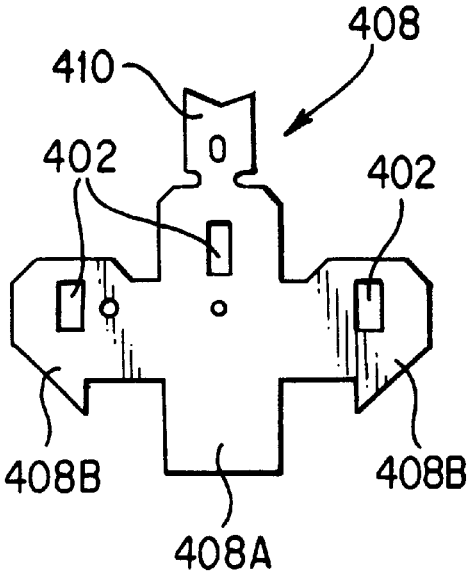
FIGS. 9A–9B show the thin media in accordance with the embodiment shown in FIG. 2.
Figure 9B:
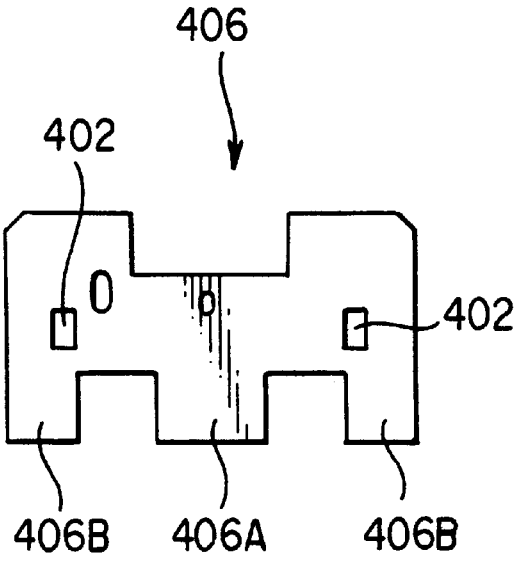

The agitator may also have 3 or more film members, of course. Furthermore, the second film member 408 may be rotated later than the first film member 406. In such a case, the film members 406/408, as shown in FIG. 9, are each provided with a center part 406A/408A and a side part 406B/408B. The center part 408A of the second film member 408 is shorter than the center part 408A of the second film member 408 in the radial direction (see FIG. 8B). With this structure, when the toner that is stirred by the rotation of the center part 406A of the first film member 406 begins flowing behind the center part 406A and then in the reverse direction, the center part 408A of the second film member 408, which is longer than that of the first film member 406, prevents the reverse flow of the toner.

Because both the toner stirring members 406A and 408A of the first and second film members 406 and 408 are set to be longer than the inner radius of the resin body 202, the tips of the elastic film members 406 and 408, as shown in FIGS. 2 and 3, are bent when they contact the inner surface of the resin body 202, so that they stir toner which is being pushed out in the rotating direction. Thus, the toner can be sufficiently stirred and supplied into the developing chamber.

The rotary shaft 300 is provided with a wiping elastic film 410 used to wipe the toner off of the toner detecting point 240 in the toner cartridge 30. The wiping film 410 and the film members 406 and 408 of the center rocking feather 400 are disposed on both sides of the rotary shaft 300. Consequently, the elastic center rocking feather 400 operates so that the second film member 408, that rotates by following the first film member 406, prevents the toner from flowing in a reverse direction when the toner, stirred by the first film member 406, begins flowing behind the film member 406 and then in the reverse direction. In addition, the elastic wiping film 410 wipes the toner off of the toner detecting point 240 in the toner cartridge 30.

The amount of toner supplied from the openings 206 and 30A can be adjusted by changing the shape of the side part 408B of the second film member 408, such as to a triangle. A triangular shape can prevent the toner in the toner cartridge 30 from scattering. In this embodiment, the wiping film 410 is formed integrally with the second film member 408. The first film member 406 and the second film member 408 can therefore be attached to the shaft 300 by a clip 318. The wiping film 410 may also be formed separately from the second film member 408. Also, the shape of the first film member 406 may be changed to adjust the amount of toner supply.

The opening 230 provided on the opposite side of the blow-molded resin body 202, as shown in FIG. 6, is tapered toward the tip, so that it functions as a bearing member of the shaft 300. A fitting recess 302 and a flange 304, as shown in FIGS. 7 and 8, are provided at one end of the shaft 300 of the stirring member 32. A driving shaft member (not illustrated) is fit and rotated in the recess 302 and the flange 304. Thus, rotation of the driving shaft member which is driven by a motor in the recess 302 causes the recess 302 and the flange 304 to rotate with the driving shaft member. Because the stirring member 32 rotates in the resin body 202 of the cartridge 30 at this time, the recess 302 and the flange 304 operate as a power transmission member for rotating the stirring member.

To rotate the stirring member 32 in the toner cartridge 30, the recess 302 must be inserted in the opening 230 of the toner cartridge 30, as shown in FIG. 7, and the stirring member rotating power must be transmitted to both the recess 302 and the flange 304. At this time, toner leaks from the toner cartridge 30 must also be prevented. Because the toner cartridge 30 is blow-molded, the manufacturing cost is low. However, the inner surface of the blow-molded resin body 202 is always not flat. Thus, there is always a possibility that toner leaks will occur between the inner surface of the resin body 202 and the recess 302.

Figure 11A:
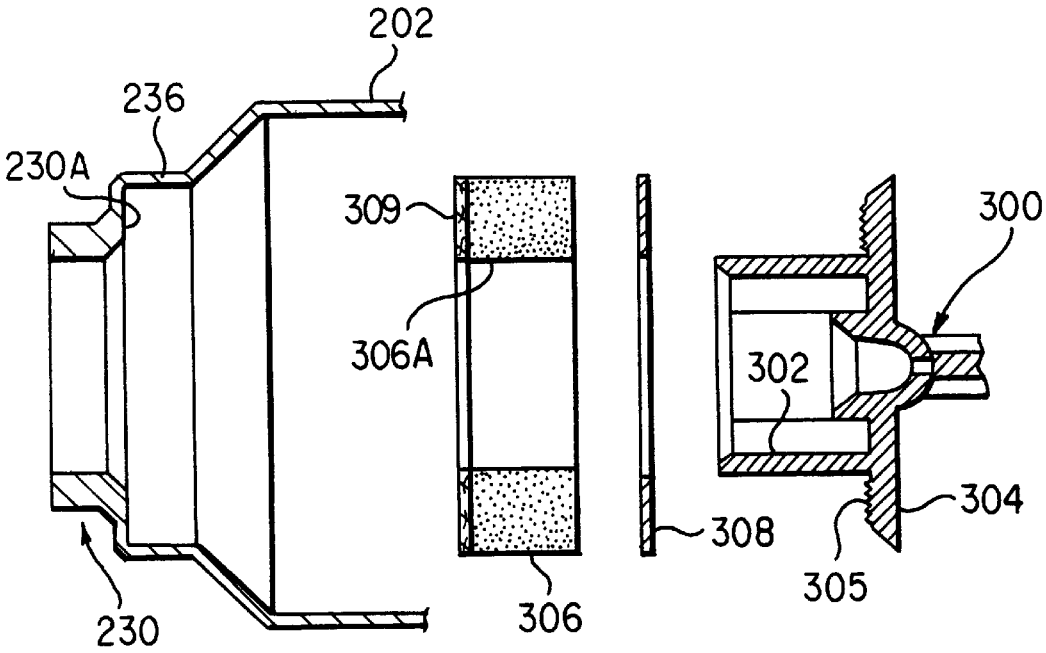
FIGS. 11A–11B show how the fitting recess and the flange in accordance with the embodiment shown in FIG. 2 are fit in a port of the toner cartridge.
Figure 11B:
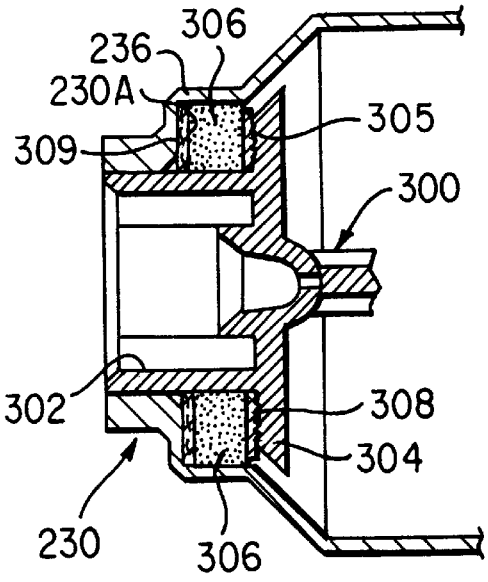

In order to prevent such toner leaks, a sealing soft member 306 is attached closely to both the recess 302 and the flange 304, as shown in FIGS. 11A and 11B. The sealing member is made of, for example, sponge such as urethane foam. The sealing member can efficiently prevent toner leaks from occurring between the inner surface of the resin body 202 and the recess 302. A washer member 308 is preferably disposed among the sealing soft member 306, the recess 302, and the flange 304 to prevent the sealing member 306 from rotating. The sealing member 306 may comprise an anti-wear film such as Teflon felt, polyethylene terephthalate, or similar material.

Figure 10A:
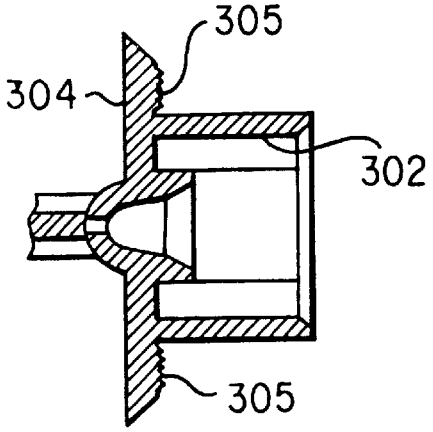
FIGS. 10A–10C show a fitting recess and a flange in accordance with the embodiment shown in FIG. 2.
Figure 10B:
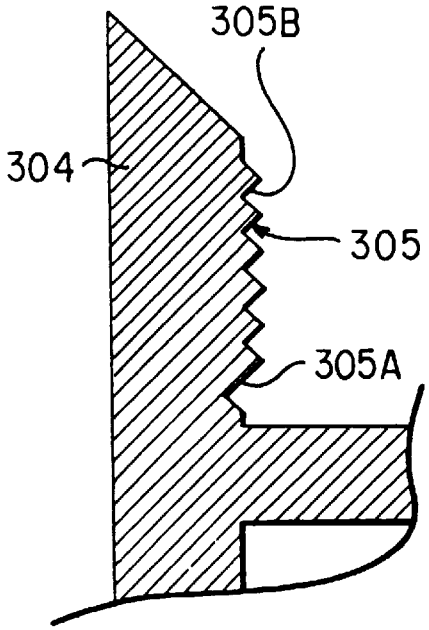
Figure 10C:
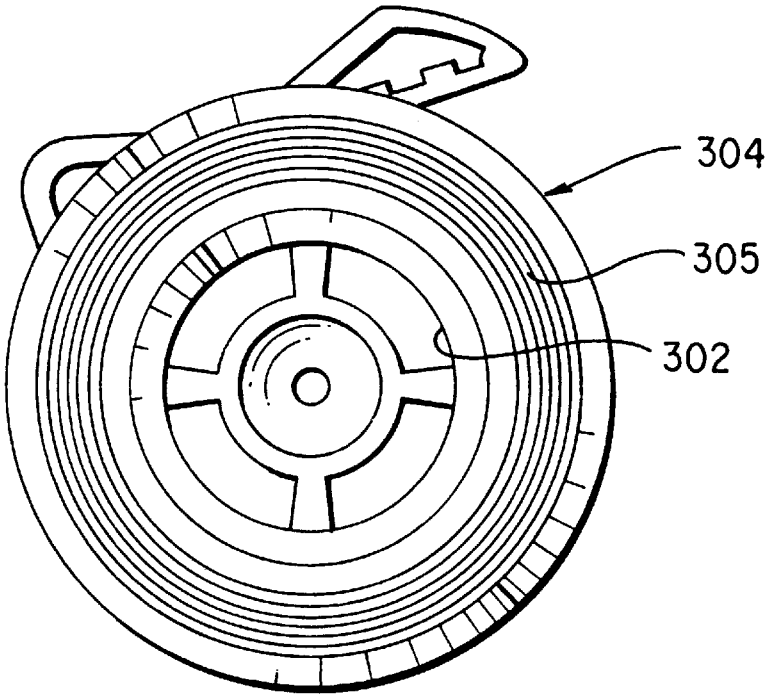

An uneven portion 305 is provided as shown in FIGS. 10A–10C, at least on one of the contact surfaces between the washer member 308 and the flange 304, i.e., on the contact surface of the flange 304.

FIG. 10A is cross sectional view of the fitting recess 302 and the flange 304. FIG. 10B is a front view of the recess 302 and the flange 304. FIG. 10C is a cross sectional view of the flange 304 and the uneven portion 305.

When the flange 304 is provided with the uneven portion 305, the contact area between the washer member 308 and the flange 304, as well as the contact resistance between these elements is reduced. Accordingly, the sealing soft member 306 is prevented from rotating via the washer member 308 in the toner cartridge 30, which prevents problems such as toner leaks from occurring even when the recess 302 and the flange 304 for rotating the stirring member are rotated.

Furthermore, if toner enters between the contact surfaces of the washer member 308 and the flange 304, it causes the frictional resistance between the contact surfaces of these elements to be increased. However, because toner actually enters the uneven portion 305, almost no toner enters between the contact surfaces of the washer member 308 and the flange 304. Thus, the uneven portion 308 can prevent the frictional resistance from increasing.

Furthermore, since the uneven portion 305 comprises a plurality of grooves formed in a pattern of concentric circles as shown in FIG. 10B in this embodiment, the contact surface of the washer member 308 only contacts the projection 305 formed on the contact surface of the flange 304, so that the contact area, as well as the frictional resistance between these elements is reduced. Consequently, the washer member 308 in the toner cartridge 30 can prevent the sealing soft member 306 from rotating when the recess 302 and the flange 304, used for rotating the stirring member, are rotated.

Furthermore, because groove 305A, formed in the center of a plurality of grooves in the uneven portion 305, is deeper than groove 305B formed outside of groove 305A, as shown in FIG. 10C, toner is apt to enter the groove 305A. Thus, almost no toner enters between the contact surfaces of the washer member 308 and the flange 304, so groove 305A is effective in preventing frictional resistance between the washer member 308 and the flange 304 from increasing. Accordingly, the sealing soft member 306 in the toner cartridge 30 can be prevented from rotating, even when the recess 302 and the flange 304 that rotates the stirring member are rotated.

Furthermore, grease is preferably applied to the contact surface around the recess 302, the flange 304, and the sealing soft member 306. Specifically, grease is preferably coated on the inner peripheral surface 306A (see FIG. 11A) of the sealing soft member 306. In this case, because the sliding resistance between the contact surfaces of the recess 302, the flange 304, and the sealing soft member 306 is reduced, the sealing soft member 306 in the toner cartridge 30 can be prevented from rotating even when the recess 302 and the flange 304 that rotate the stirring member are rotated. The grease should be selected from a material having an oil content that does not ooze out easily. The grease does not stick to the toner in the toner cartridge 30, however, when a small amount of the oil in the grease oozes out. This is because the oil content is pooled in the uneven portion 305 on the contact surface of the flange 304.

The washer member 308 does not have to be placed between the contact surfaces of the recess 302, the flange 304, and sealing soft member 306. Instead of the washer member 308, the recess 302 and the flange 304 to which the sealing soft member 306 are attached may be inserted in the opening 230 of the toner cartridge 30. However, an uneven portion 305 should preferably be provided at least on one of the contact surfaces of the sealing soft member 306, the fitting recess 302, and the flange 304. Specifically, an uneven portion 305 should be provided on the contact surface of the flange 304. With this structure, the contact surface area between the contact surface of the sealing soft member 306 and the contact surface between the fitting recess 302 and the flange 304 is reduced, allowing the contact resistance to be reduced effectively.

Furthermore, an absorbing member 309 is preferably stuck on the contact surface on which the sealing soft member 306 contacts the inner surface 230A of the toner cartridge 30 (see FIG. 11) when the recess 302 and the flange 304 are inserted in the opening 230 via the sealing soft member 306. The absorbing member 309 is fixed on one side of the sealing soft member 306 that is made of a sponge member used as a foaming material. Consequently, the flange 304, used as a pressing member, is pressed against the inner surface 230A (see FIGS. 11A–11B) of the opening 230 from the opposite side (the absorbing member 309 is not fixed) of the sealing soft member 306. The absorbing member 309 thus closely contacts the inner surface 230A.

The absorbing member 309 is preferably made of, for example, a soft resin film having excellent adhesive properties and a thickness of approximately 100 ms. In this embodiment, an SG sheet (Bridgestone Inc.) is used.

The absorbing member 309 does not stick to the inner surface of the resin body 202 of the toner cartridge 30 when the assembly of the recess 302 and the flange 304 is fit into the opening 230 via the sealing soft member 306. The absorbing member 309 closely contacts the contact inner surface 230A of the opening 230 (see FIG. 11) more firmly over time, since that is always pressed against the inner surface 230A. Accordingly, because the sealing soft member 306 in the toner cartridge 30 can be prevented from rotating even when the recess 302 and the flange 304 that rotates the stirring member are rotated, toner leaks are effectively prevented from occurring between the inner surface of the resin body 202 and the recess 302.

Furthermore, at cap 500 is provided at one end of the toner cartridge 30. The cap 500 is formed of an appropriate size to seal the ends of the blow-molded resin body 202. A projection 245 is provided on the outer periphery of the resin body 200 (see FIG. 6). The projection 245 is formed to fit into a recess 508. When the projection 245 is fit into the recess 508, the cap 500 is fixed so that it cannot be rotated relative to the resin body 202 (see FIG. 5). A knob 506 is formed so that it is integrated with the cap 500 and protrudes in the radial direction. The knob 506 is operated to mount the toner cartridge 30 in the process cartridge 7.

The cap 500 of the toner cartridge 30 is provided with a projection 510 that operates as a fitting member for indicating the type of the toner cartridge 30. The process cartridge 7 is provided with a recess 71 in which only the specified projection 510 is fit. A recess 512 is provided outside of the toner cartridge 30 and a projection 73 is provided inside the process cartridge 7. The projection 73 is fit into the recess 512. Specifically, the projection 510 protrudes in the circumferential direction of the cap 500. The recess 71 is formed as a key groove at the inlet port of the process cartridge 7. The recess 512 is provided in the lower portion of the knob 506 and the projection 73 protrudes from the inlet port of the process cartridge 7.

Figure 12A:
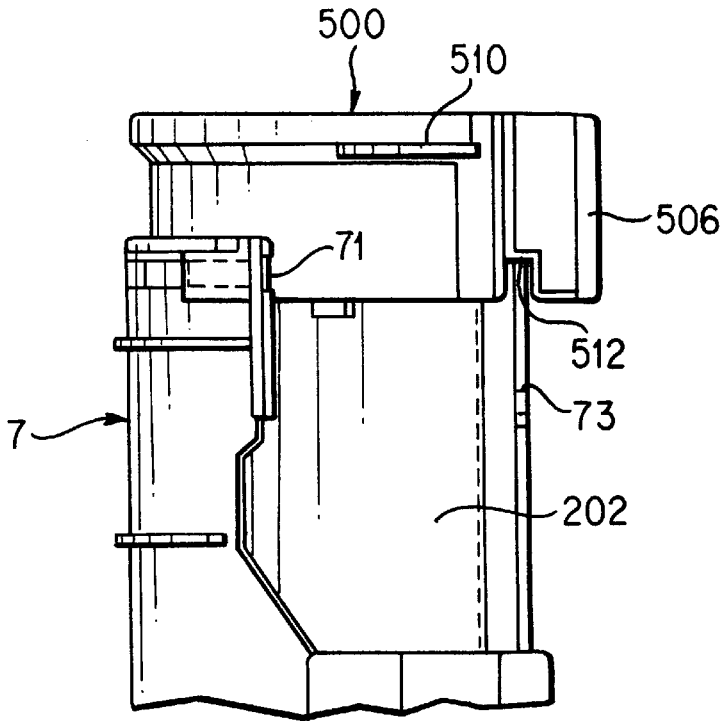
FIGS. 12A–12B show the toner cartridge in accordance with the embodiment shown in FIG. 2, mounted in a process cartridge.
Figure 12B:
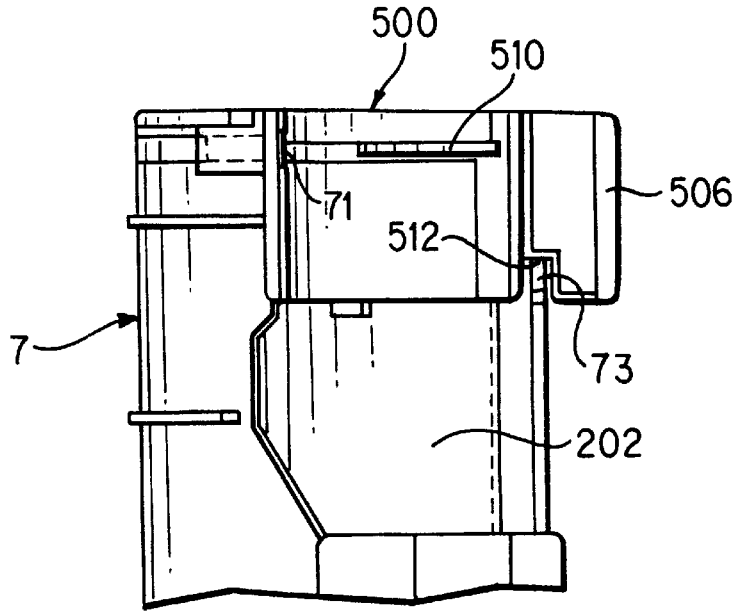
Figure 13A:
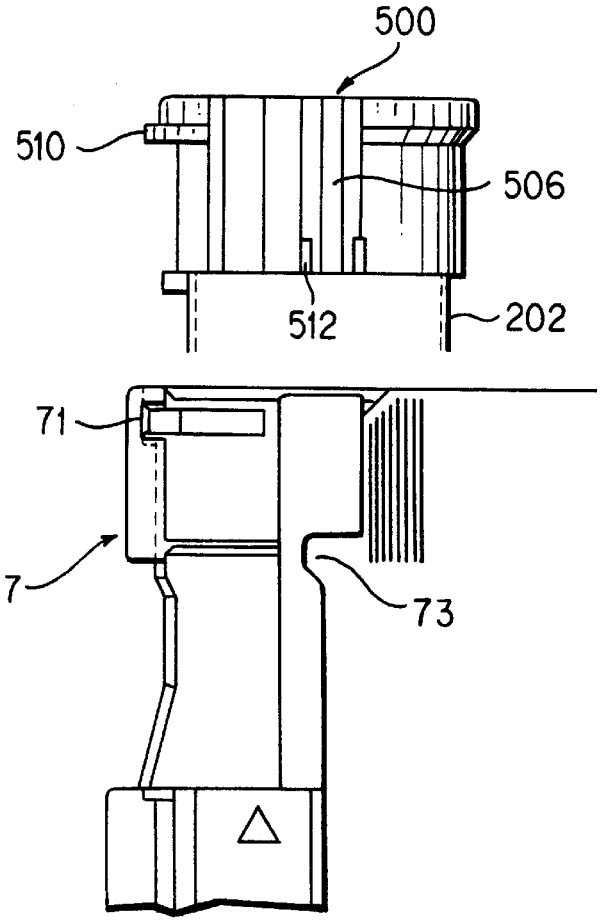
FIGS. 13A–13B show the toner cartridge in accordance with the embodiment shown in FIG. 2, mounted in a process cartridge.
Figure 13B:
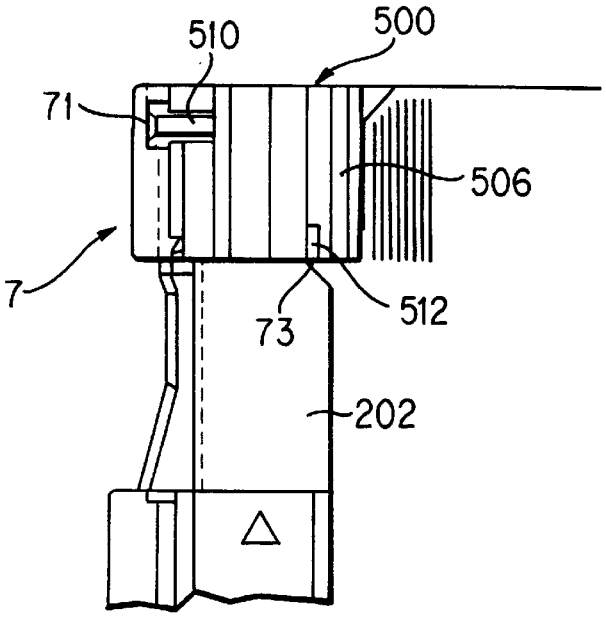

With this structure, when the toner cartridge 30, positioned as shown in FIGS. 12A and 13A, is loaded in the process cartridge 7, and the projection 73, fit in the recess 512 (as shown in FIGS. 12B and 13B), is rotated in one direction, the projection 510 fits into the recess 71 of the process cartridge 7. When the toner cartridge 30 is removably mounted in a normal process cartridge 7 and rotated, the projection 510 and the recess 512 of the toner cartridge 30 fit into the recess 71 and the projection 73 of the process cartridge 7, respectively.

Another embodiment of the invention is described below. The cap 500 of the toner cartridge 30 is provided with a projection 520 that operates as a fitting member for indicating the type of cartridge 30. The process cartridge 7 is provided with a fitting recess 77 that only receives the specified projection 520. In addition, a projection 75 is provided inside the process cartridge 7. Specifically, the projection 520 protrudes in the circumferential direction of the cap 500 and the recess 77 is formed as a key groove at the inlet port of the process cartridge 7. The recess 522 is provided in the lower portion of the cap 500 and the projection 75 protrudes from the inlet port of the process cartridge 7.

Figure 14:
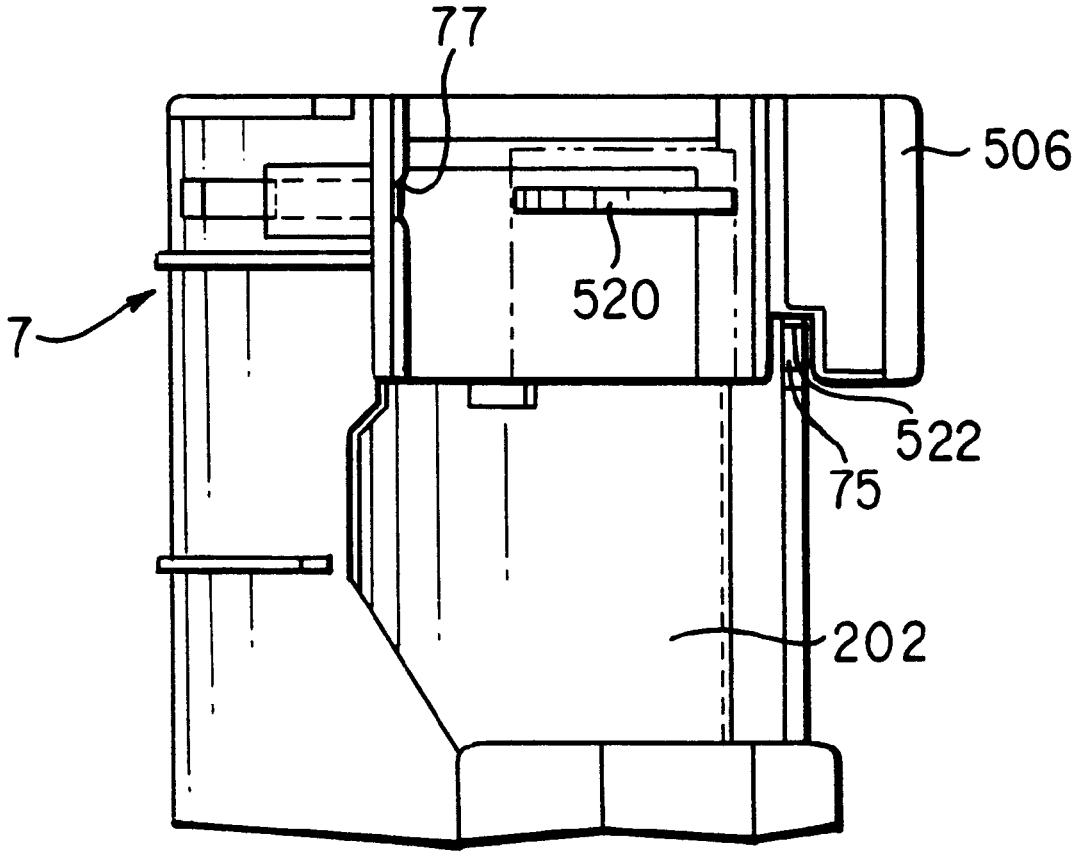
FIG. 14 is a front view of a toner cartridge in accordance with another embodiment, mounted in a process cartridge.

When the toner cartridge 30, positioned as shown in FIG. 14, is inserted in the process cartridge 7 and is rotated one way after the projection 75 is fit into the recess 522, the projection 520 fits into the recess 77 of the process cartridge 7. Consequently, the projection 520 and the recess 522 of the toner cartridge 30 are fit into the process cartridge 7, having the recess 77 and the projection 75 defined normally, when the toner cartridge 30 is removably mounted in the normal process cartridge 7 and rotated.

Consequently, when the toner cartridge 30, shown in FIGS. 12A–12B, is to be mounted in the normal process cartridge 7, shown in FIGS. 12A–12B, the projection 510 and the recess 512 of the toner cartridge 30 are only fit in the process cartridge 7 having the recess 71 and the projection 73 defined normally. In the same manner, when the toner cartridge 30, shown in FIG. 14, is to be mounted in the normal process cartridge 7, shown in FIG. 14, the projection 520 and the recess 522 of the toner cartridge 30 are only fit in the process cartridge 7, having the recess 77 and the projection 75 defined normally.

Alternatively, when the toner cartridge 30, shown in FIGS. 12A–12B, is to be mounted in the non-normal process cartridge 7 shown in FIG. 14, the projection 510 and the recess 512 are not fit in the recess 75 and the projection 77. Thus, the toner cartridge 30 cannot be mounted in the process cartridge 7. Accordingly, the toner cartridge 30 is effectively prevented from being improperly mounted.

This is also true when the toner cartridge 30, shown in FIG. 14, is to be mounted in the non-normal process cartridge 7, shown in FIGS. 12A–12B.

Furthermore, when the toner cartridge 30 is mounted in the process cartridge 7, the projection 510, which is a fitting part for indication, the recess 512, the projection 520, and the recess 522 can be positioned in the recess 71, which is a normal receiving fitting part, the projection 73, the recess 75, and the projection 77 correctly. The relationship between the projections and recesses may be reversed.

Figure 15A:
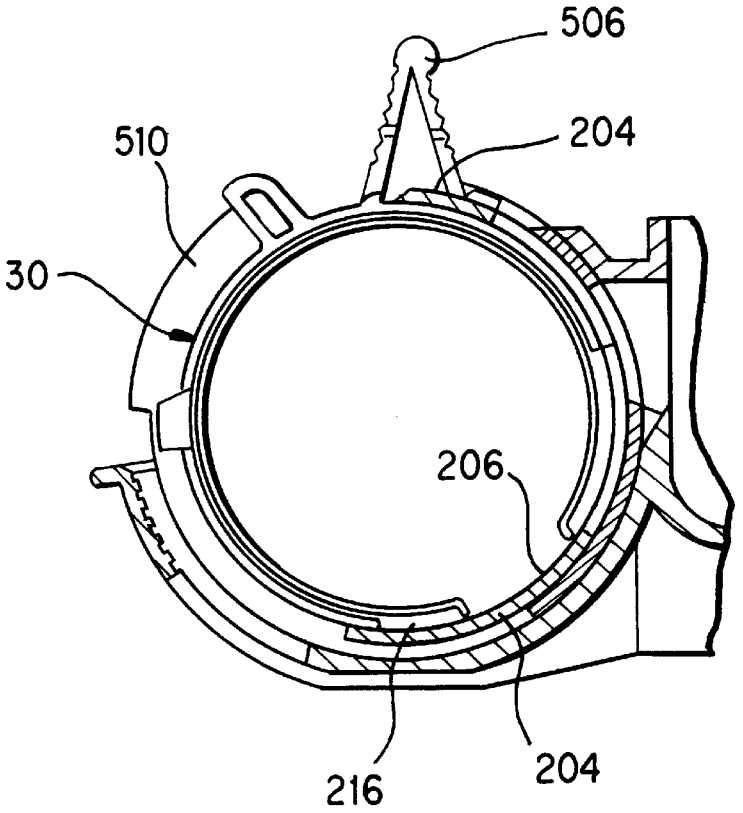
FIGS. 15A–15B show the toner cartridge in accordance with the embodiment shown in FIG. 14, mounted in a process cartridge.
Figure 15B:
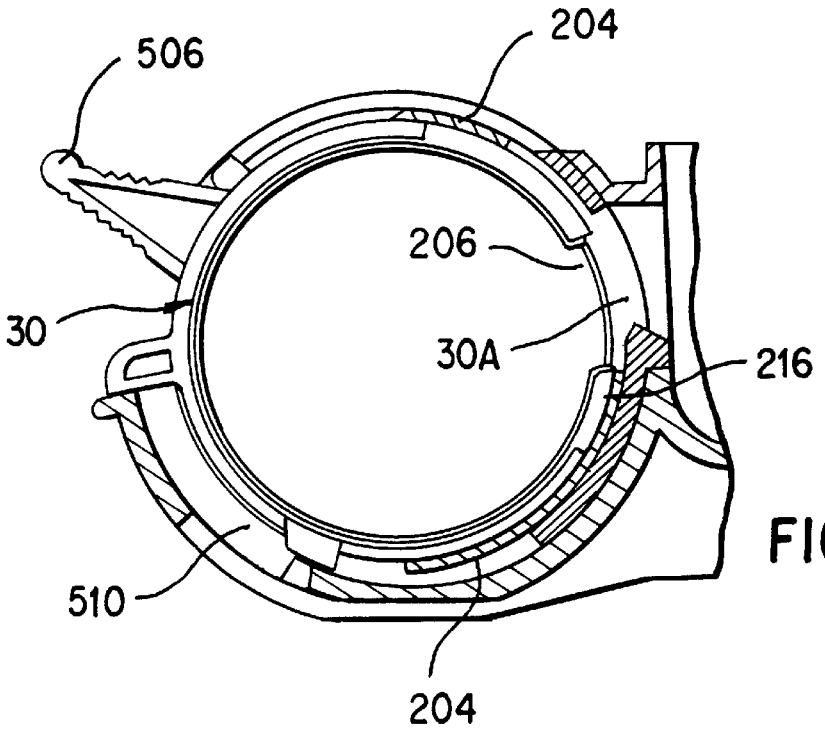

When the normal toner cartridge 30 is inserted in the direction of the arrow shown in FIG. 4 with respect to the normal process cartridge 7, the extended part 210 of the toner introduction port sealing member 204 is fit into the fixed releasing member (not illustrated) provided in the process cartridge 7. Consequently, the extended part 210 is bent in the direction and separated from the outer surface of the blow-molded resin body 202. Thus, the projection 214 of the blow-molded resin body 202 is released from the recess 212 of the sealing member 204. When the knob 506 of the cap 500 is operated in this position to rotate the toner cartridge 30 with respect to the sealing member 204, the toner introduction port 206 can be opened (as shown in FIGS. 15A–15B).

Since the toner introduction port 206 is opened and toner is supplied to the process cartridge 7 by the rotation of the toner cartridge 30 mounted in the process cartridge 7 in this manner, toner never leaks from the process cartridge 7 and toner is reliably supplied into the process cartridge 7 from the toner introduction port 206 of the toner cartridge 30. Consequently, since toner never leaks, no contamination is caused by toner inside the laser printer 1.

The invention is not limited to only the above embodiments, of course. As long as the concept of the invention is kept, the embodiment can be varied and modified freely.

For example, the image forming apparatus can be adopted for copying machines, facsimiles, printers, and similar devices. Furthermore, the invention can apply not only to a situation in which the toner cartridge 30 and the process cartridge 7 are combined for manufacturing and selling, but also to a situation in which the toner cartridge 30 and the process cartridge 7 are manufactured and sold separately. Furthermore, the toner cartridge 30 may be formed integrally with the process cartridge 7 so as to be removed. And, as shown in the above embodiments, the toner cartridge 30 may be formed so as to be mounted/removed freely in/from the process cartridge 7.

What is claimed is:

1. A developing device for use with an image forming apparatus that forms images with toner by electrophotographic processes, comprising:

a toner reservoir that contains toner;

a rotary shaft disposed in the toner reservoir;

an agitator attached to the rotary shaft and rotatable to stir the toner in the toner reservoir, the agitator including a first medium and a second medium, the first medium and the second medium each being elastic and thin; and a toner introduction port that supplies toner after the toner is stirred in the toner reservoir by the agitator;

wherein the first medium rotates initially and the second medium rotates following the first medium.

2. The developing device according to claim 1, wherein the first medium includes a first toner stirring member and the second medium includes a second toner stirring member, the first toner stirring member being shorter than the second toner stirring member in a radial direction.

3. The developing device according to claim 2, wherein the first toner stirring member and the second toner stirring member are each longer than an inner radius of the toner reservoir in the radial direction.

4. The developing device according to claim 3, further including a wiping medium attached to an opposite side of the rotary shaft from the agitator, the wiping medium being elastic and thin, the wiping medium wiping toner off of a toner detecting point in the toner reservoir.

5. The developing device according to claim 4, wherein an amount of toner supplied via the toner introduction port is adjustable by changing a shape of the first toner stirring member and the second toner stirring member.

6. The developing device according to claim 5, wherein the wiping medium is shaped as an arrow feather.

7. The developing device according to claim 6, wherein the rotary shaft defines at least one clip, and the first toner stirring member and the second toner stirring member each define at least one aperture, the at least one clip extending through the at least one aperture.

8. An image forming apparatus that forms images with toner by electrophotographic processes, comprising:

a toner reservoir that contains toner and defines a toner detecting point within the toner reservoir;

a rotary shaft disposed in the toner reservoir;

an agitator attached to the rotary shaft and rotatable to stir the toner in the toner reservoir, the agitator including a first medium and a second medium, the first medium and the second medium each being elastic and thin;

a toner introduction port that supplies toner after the toner is stirred in the toner reservoir by the agitator; and a residual toner sensor disposed outside of the toner reservoir that detects a residual toner level at the toner detecting point;

wherein the first medium rotates initially and the second medium rotates following the first medium to adjust the movement of toner within the toner reservoir at least at the toner detecting point.

9. The image forming apparatus according to claim 8, wherein a first recess is defined at one side of the toner detecting point and a second recess is defined at another side of the toner detecting point.

10. The image forming apparatus according to claim 9, wherein the residual toner sensor includes a light emitter and a light receiver, the light emitter disposed in the first recess and the light receiver disposed in the second recess.

11. The image forming apparatus according to claim 10, wherein the first medium includes a first toner stirring member and the second medium includes a second toner stirring member, the first toner stirring member being shorter than the second toner stirring member in a radial direction.

12. The image forming apparatus according to claim 11, wherein the first toner stirring member and the second toner stirring member are each longer than an inner radius of the toner reservoir in the radial direction.

13. The image forming apparatus according to claim 12, further including a wiping medium attached to an opposite side of the rotary shaft from the agitator, the wiping medium being elastic and thin, the wiping medium wiping toner off of a toner detecting point in the toner reservoir.

14. A cartridge that is fillable with toner for use with a developing device in an image forming apparatus that forms images with toner by electrophotographic processes, comprising:

a toner reservoir that contains toner;

a rotary shaft disposed in the toner reservoir;

an agitator attached to the rotary shaft and rotatable to stir the toner in the toner reservoir, the agitator including a first medium and a second medium, the first medium and the second medium each being elastic and thin; and a toner introduction port that supplies toner after the toner is stirred in the toner reservoir by the agitator;

wherein the first medium rotates initially and the second medium rotates following the first medium.

15. The cartridge according to claim 14, wherein the first medium includes a first toner stirring member and the second medium includes a second toner stirring member, the first toner stirring member being shorter than the second toner stirring member in a radial direction.

16. The cartridge according to claim 15, wherein the first toner stirring member and the second toner stirring member are each longer than an inner radius of the toner reservoir in the radial direction.

17. The cartridge according to claim 16, further including a wiping medium attached to an opposite side of the rotary shaft from the agitator, the wiping medium being elastic and thin, the wiping medium wiping toner off of a toner detecting point in the toner reservoir.

18. The cartridge according to claim 17, wherein an amount of toner supplied via the toner introduction port is adjustable by changing a shape of the first toner stirring member and the second toner stirring member.

19. The cartridge according to claim 18, wherein the wiping medium is shaped as an arrow feather.

20. The cartridge according to claim 19, wherein the rotary shaft defines at least one clip, and the first toner stirring member and the second toner stirring member each define at least one aperture, the at least one clip extending through the at least one aperture.

21. A method of manufacturing a developing device for use with an image forming apparatus that forms images with toner by electrophotographic processing, comprising the steps of:

providing a toner reservoir that contains toner;

placing a rotary shaft within the toner reservoir;

attaching an agitator to the rotary shaft such that the agitator is rotatable to stir the toner in the toner reservoir, the agitator including a first medium and a second medium, the first medium and the second medium each being elastic and thin, the first medium being rotatable initially and the second medium being rotatable following the first medium; and providing a toner introduction port for supplying toner after the toner is stirred in the toner reservoir by the toner agitator.

* * * * *